United States Patent [19]

Mueller

[11] Patent Number: 4,886,383

[45] Date of Patent: Dec. 12, 1989

[54] TAPE CASSETTE FOR METERING CORRECTION TAPE FEED

[75] Inventor: Hans W. Mueller, Cortland, N.Y.

[73] Assignee: Smith Corona Corporation, Cortland, N.Y.

[21] Appl. No.: 161,870

[22] Filed: Feb. 29, 1988

[51] Int. Cl.[4] ..... B41J 32/00

[52] U.S. Cl. ..... 400/208; 400/232; 400/697.1

[58] Field of Search ..... 400/207, 208, 208.1, 400/219.3, 232, 695, 696, 697, 697.1; 15/DIG. 2

[56] References Cited

U.S. PATENT DOCUMENTS

| | | | |
|---|---|---|---|
| 3,348,650 | 10/1967 | Meinherz et al. | 400/232 X |
| 3,667,486 | 6/1972 | Cole et al. | 15/DIG. 2 |
| 3,677,486 | 7/1972 | Findlay | 400/232 X |
| 3,923,141 | 12/1975 | Henglehaupt | 400/208 |
| 4,302,118 | 11/1981 | Schaefer | 400/697.1 X |
| 4,475,829 | 10/1984 | Goff, Jr. et al. | 400/232 |
| 4,616,945 | 10/1986 | Komplin | 400/208 X |

FOREIGN PATENT DOCUMENTS

| | | | |
|---|---|---|---|
| 0178884 | 11/1982 | Japan | 400/234 |

OTHER PUBLICATIONS

IBM Technical Disclosure Bulletin, "Low Cost Cartridge Code Detector", Craft, vol. 25, No. 4, Sep. 1982, pp. 1980 and 1981.

*Primary Examiner*—Ernest T. Wright, Jr.

[57] ABSTRACT

A tape cassette has a sensing arm pivotally mounted therein biased against a correction tape on a take-up spool for sensing the amount of correction tape thereon. A correction tape feed mechanism mounted in a typewriter has a metering post for engaging the sensing arm at varying locations to cause the correction tape feed mechanism to feed the correction tape at substantially equal amounts regardless of the amount of correction tape on the take-up spool.

15 Claims, 5 Drawing Sheets

TAPE CASSETTE FOR METERING CORRECTION TAPE FEED

BACKGROUND OF THE INVENTION

1. Field of the Invention

This invention is concerned with a tape cassette for metering the amount of typewriter correction tape that is fed from a correction tape cassette to a typewriter print point, and more particularly, with such a system in which the amount of typewriter correction tape that is fed to the print point is relatively constant regardless of the amount of tape on the take-up spool. The metering system also includes a correction tape feed mechanism that varies the amount of correction tape that is fed to the print point in accordance with the type of correction tape.

In a typical correction tape system for use in a typewriter, the correction tape extends from a supply spool to a position below the typewriter print point and then to a take-up spool. In a correction tape cassette system, such as the present invention, the supply spool, correction tape, and take-up spool are all housed in a cassette which is mounted on a cassette rocker. The cassette rocker is carried by and pivotable on a print wheel and ribbon carrier that is moveable along a line of type. When a character is to be deleted during an error correction step, the cassette rocker is pivoted upwardly to move the correction tape to the print point for the subsequent character deletion step.

Prior to use, a fresh, correction tape will be located almost entirely on the cassette supply spool (i.e. the diameter of the correction tape on the supply spool will be at its maximum), while the amount of correction tape on the take-up spool will be at its minimum. After each correcting operation, a drive means rotates the take-up spool to pull fresh correction tape from the supply spool and, in this manner, fresh tape is presented at the print point. As the correction tape is pulled from the supply spool, the amount (and diameter) of the correction tape on the supply spool is reduced, and the amount (and diameter) of the correction tape on the take-up spool is increased.

In order to reduce the amount of correction tape wastage, it is desirable to move only the required constant amount of correction tape to the typewriter print point. If, however, the take-up spool rotates the same amount each time a correction operation occurs, the amount of correction tape moved across the typewriter print point will not be constant, but will vary, because of the variations in the diameter of the correction tape on the take-up spool. For example, for the same amount of correction tape spool rotation, a smaller diameter of correction tape on the take-up spool will cause a lesser amount of correction tape to be fed to the typewriter print point than will a larger diameter of correction tape on the take-up spool. The present invention is concerned with a system for varying the amount of the take-up spool rotation in accordance with the diameter of correction tape on the take-up spool, so that the required constant amount of correction tape is moved across the typewriter print point regardless of the diameter of correction tape on the take-spool.

The present invention is also concerned with a system for metering the proper amount of correction tape that is fed to the print point in accordance with the type of the correction tape utilized in the cassette. There are, for example, in present usage, at least two types of typewriter correction tapes. One type is commonly referred to as "lift-off" tape. In operation, the lift-off tape is raised to the typewriter print point and the character on the type element which corresponds to the character to be deleted is positioned to strike the lift-off tape. Typewriter actuating means causes the type element to strike the lift-off tape against the unwanted character and, upon withdrawal of the lift-off tape from the paper, the tape lifts the unwanted character from the paper.

The other type of typewriter correction tape is commonly referred to as "cover-up" tape. In operation, the cover-up tape is raised to the typewriter print point and the character on the type element which corresponds to the character to be deleted is positioned to strike the cover-up tape. Typewriter actuating means causes the type element to strike the cover-up tape against the unwanted character and, upon the element striking the cover-up tape against the unwanted character, a powdery substance on the cover-up tape is transferred to and covers up the unwanted character.

Both the lift-off tape and cover-up tape may be housed within cassettes, and both may be used in the same typewriter, the choice of correction tapes being generally dependent upon the characteristics of the print ribbon being used for the printing operation. It is known that the amount of lift-off correction tape that must be fed to the print point to effectively lift off an unwanted character is less than the amount of cover-up correction tape that must be fed to the print point to effectively cover up an unwanted character. If, therefore, the typewriter correction feed mechanism always fed an amount of correction tape adequate for cover-up correction tape, it would feed an excessive and wasteful amount of lift-off tape when lift-off tape, and not cover-up correction tape, was present in the typewriter. On the other hand, if the typewriter correction feed mechanism always fed an amount of correction tape adequate for lift-off correction tape, it would feed an insufficient amount of cover-up tape when cover-up tape, and not lift-off tape, was present in the typewriter.

The present invention provides an improved correction tape metering system whereby the amount of tape that is fed is dependent on the diameter of correction tape on the take-up spool and is dependent upon the particular type of typewriter correction tape that is being utilized in the typewriter operation.

2. Prior Art

An example of a typewriter print ribbon metering device is disclosed in U.S. Pat. No. 4,302,118. Means are provided on the cassette for indicating whether the content of the cassette includes a carbon or cloth ribbon. Upon the cassette being inserted into the typewriter, the correct feed and ribbon lift mechanism is automatically selected to minimize ribbon wastage.

An example of a prior art correction tape feed mechanism is shown in U.S. Pat. No. 4,616,945 wherein oscillation of the correction tape cassette operates a cam follower operated pawl and ratchet for feeding the correction tape.

A prior art typewriter ribbon feed mechanism, which is designed to achieve a nearly constant speed, is disclosed in U.S. Pat. No. 3,677,486. The device includes a camming lug which detects the changing diameter of ribbon on the ratcheted ribbon spool, and reduces the angular distance that a reciprocating pawl engages the spool as the ribbon diameter increases.

SUMMARY OF THE INVENTION

The present invention is an improved typewriter correction tape feed system in which the amount of typewriter correction tape that is fed to a typewriter print point is relatively constant, regardless of the amount of tape on the take-up spool and regardless of the type of correction tape that is being used.

BRIEF DESCRIPTION OF THE DRAWING

A further understanding of the present invention may be had when the following detailed description is read in conjunction with the accompanying drawings in which.

DETAILED DESCRIPTION OF THE PREFERRED EMBODIMENT

Figure 1:
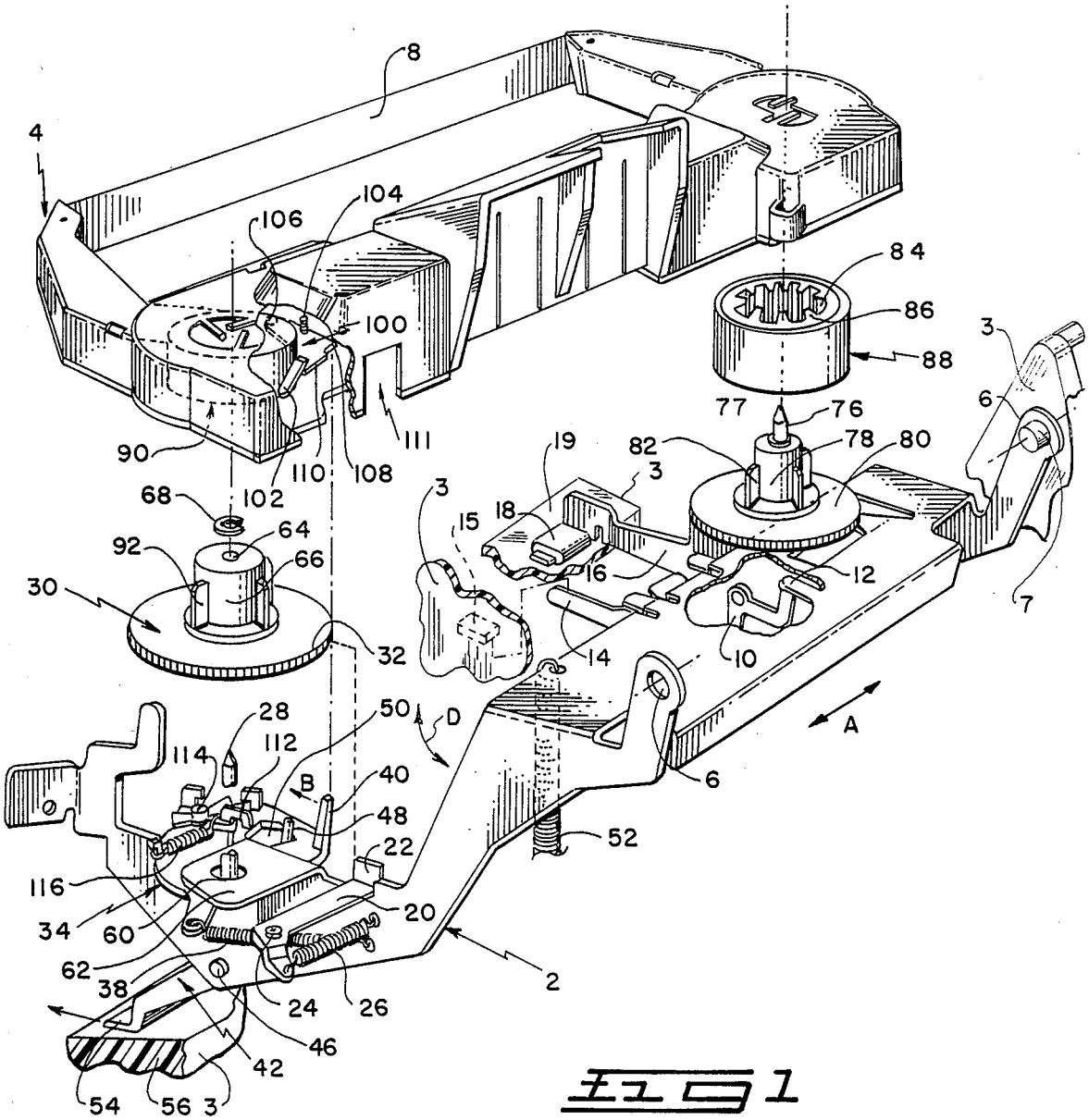
FIG. 1 is a top perspective view, with parts broken away, of the typewriter cassette rocker, the correction tape feed mechanism and the correction tape cassette made in accordance with the present invention.
Figure 2:
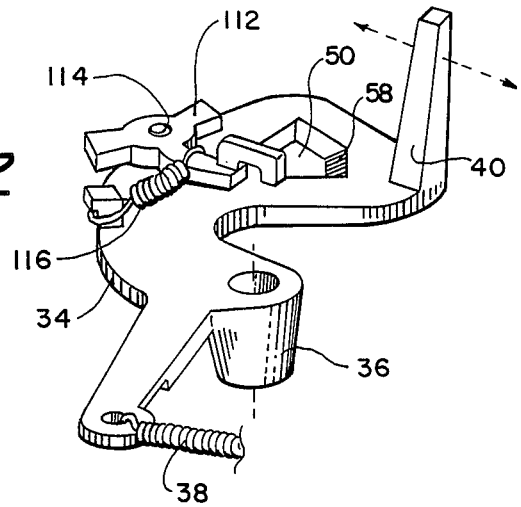
FIG. 2 is an enlarged top perspective view of a tape feed actuator and pawl of the correction tape feed mechanism shown in FIG. 1.
Figure 3:
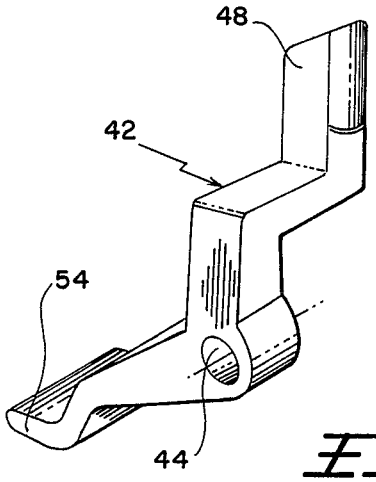
FIG. 3 is an enlarged top perspective view of an arm which operates in conjunction with the tape feed actuator shown in FIG. 2.
Figure 8:
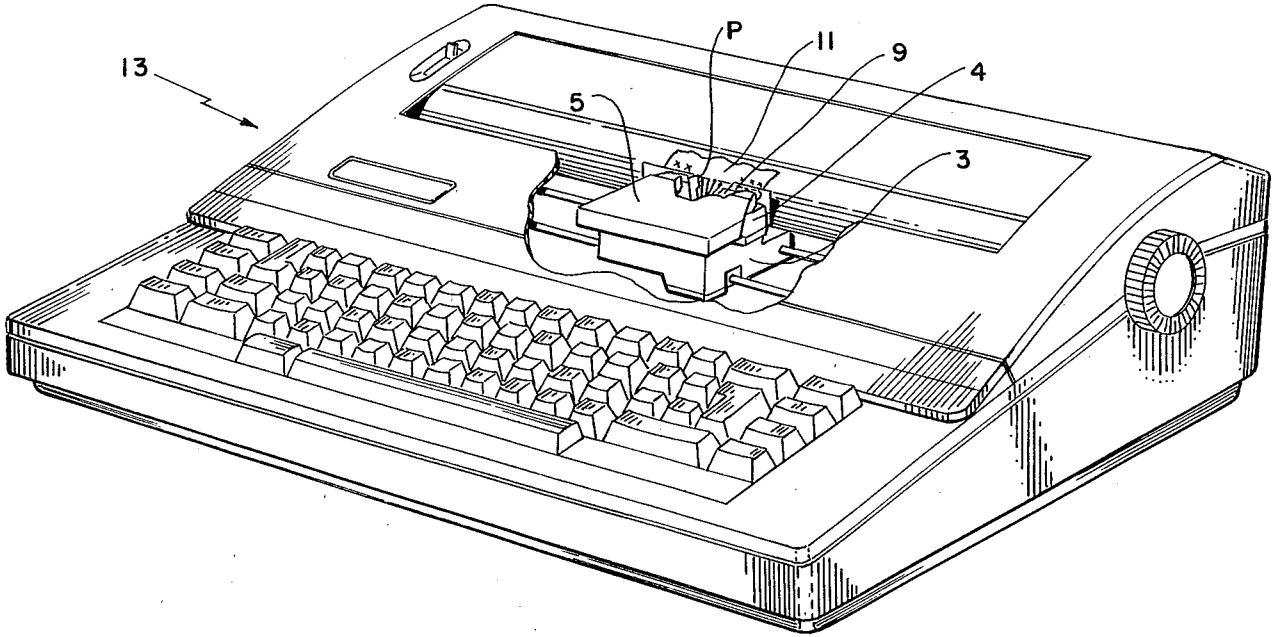
FIG. 8 is a front perspective view of a typewriter incorporating the cassette of the invention, with parts shown broken away for clarity.

There is shown in FIG. 1 a pivotable cassette rocker 2 mounted on a carrier 3 for movement in the direction of an arrow A. A typewriter ribbon cassette 5 (best seen in FIG. 8) and a correction tape cassette 45 are mounted on the cassette rocker 2 for pivotal movement therewith. The cassette rocker 2 includes pivot points 6 enabling the cassette rocker 2 to pivot clockwise in the direction of the arrow, about posts 7 (only one of which is shown in FIG. 1) in the carrier 3 for presenting either a print ribbon 9 (best seen in FIG. 8) or a correction tape 8 to the typewriter print point P for printing a character on the paper 11 or deleting a character from the paper 11. In the present instance, the discussion is limited to presenting the correction tape 8 to the print point P.

A solenoid-actuated vertically moveable arm 10 in the typewriter 13, when pivoted to its raised position, pivots a finger 12 of the pivotable cassette rocker 2 to cause the cassette rocker 2 to pivot clockwise about the carrier pivot points 6 for presenting the correction tape 8 to the print point P. An arm 14 extends from a cassette rocker 2 and contacts a portion 15 (shown hidden in FIG. 1) of the carrier 3, if and when the cassette rocker 2 is pivoted clockwise in an excessive amount. In this manner, the arm 14 serves as a limit on the amount of clockwise movement of the cassette rocker 2. An arm 16 having a finger 18 extends from the cassette rocker 2 and contacts a portion 19 of the carrier 3 to limit on the amount of clockwise movement of the cassette rocker 2.

As the cassette rocker 2 pivots clockwise, the following correction tape pre-feeding operation occurs. An arm 20 having a pawl 22 is pivotally mounted on the cassette rocker 2 by a pin 24. The arm 20 is biased counterclockwise by a spring 26 connected at one end to the cassette rocker 2. A take-up spool post 28 is mounted on the cassette rocker 2. A correction tape feed wheel 30 having peripheral teeth 32 is pivotally mounted on the take-up pool post 28. The pawl 22 is biased into engagement with the teeth 32 by the spring 26. In this manner, the pawl 22 prevents counterclockwise rotation of the correction tape feed wheel 30. A tape feed actuator 34 is pivotally mounted on the take-up spool post 28 by an integral hub 36. The tape feed actuator 34 is biased counterclockwise by a spring 38 connected at one end to the cassette rocker 2. A metering post 40 is integral with the tape feed actuator 34. An arm 42 has an opening 44 through which a rod 46 on the cassette rocker 2 extends for pivotal movement of the arm 42. The arm 42 has an upper abutment 48 shaped to fit within a slot 50 in the tape feed actuator 34.

When the cassette rocker 2 is in its normal horizontal position (i.e. it has not been pivoted to present the correction tape 8 to the print point P), a return spring 52, having one end attached to the cassette rocker 2 and having the other end (not shown) attached to the carrier portion 15, biases the cassette rocker 2 and the rod 46 carried thereon downwardly. The arm 42 which is carried by the rod 46 is likewise urged downwardly. A cam portion 54 of the arm 42 is biased against a surface 56 on the carrier 3 by the spring 38 urging a front wall 58 of the slot 50 against the abutment 48. In this manner, the arm 42 is restrained from pivoting counterclockwise about the rod 46 is the upper abutment 48 of the arm 42, which is located against the front wall 58, urges the tape feed actuator 34 clockwise to counterbalance and prevent the force of a spring 38 from rotating the tape feed actuator 34 counterclockwise.

When the cassette rocker 2 is pivoted clockwise by the arm 10 to present the correction tape 8 to the print point P, the arm 42 is free to pivot counterclockwise by the rod 46 moving above the surface 56 on the carrier 3. In this condition, the spring 38 is now able to rotate the tape feed actuator 34 and the metering post 40 thereon generally rearwardly in the direction of an arrow B. The amount of rotation of the tape feed actuator 34 is controlled by the front wall 58 pivoting the cam portion 54 of the arm 42 against the surface 56.

The take-up spool post 28 extends through an opening 60 in a platform 62 on the cassette rocker 2 and extends through an opening 64 in a hub portion 66 of the correction tape feed wheel 30. A keeper 68 secures the correction tape feed wheel 30 on the platform 62 of the cassette rocker 2.

A supply spool post 76 is mounted on the cassette rocker 2 and extends through an opening 77 in a hub portion 78 of a correction tape driven wheel 80. Paddles 82 on the hub portion 78 fit within channels 84 formed by ribs 86 in a supply spool 88. The supply spool 88 is rotated clockwise as the correction tape 8 is pulled therefrom by clockwise rotation of a take-up spool 90.

The hub portion 66 of the correction tape feed wheel 30 includes driving elements 92 which sit in channels 94 formed by ribs 96 (see FIGS. 4 and 5) in the take-up spool 90 of the correction tape cassette 4. When the correction tape feed wheel 30 is rotated clockwise, the driving elements 92 of the hub portion 66 engage and move the ribs 96 and thus the take-up spool 90 clockwise.

Figure 4:
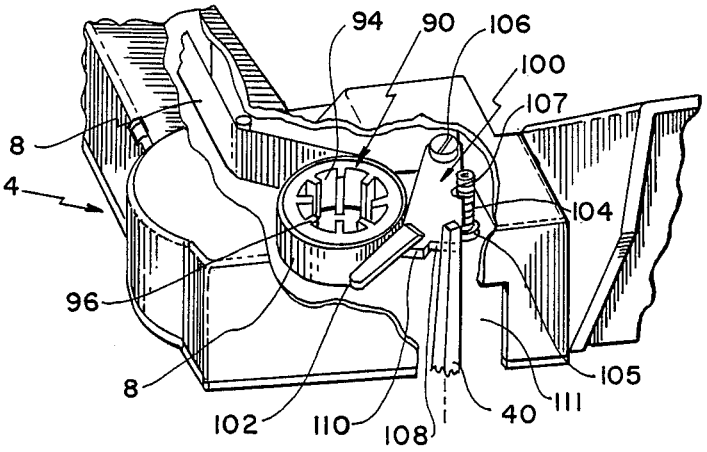
FIG. 4 is a partial top perspective view of a first embodiment of the correction tape cassette with a portion of the cassette jacketing broken away to show a sensing arm which controls the amount of tape that is fed by the typewriter correction tape feed mechanism and to show the tape take-up spool having a lesser amount of correction tape.
Figure 5:
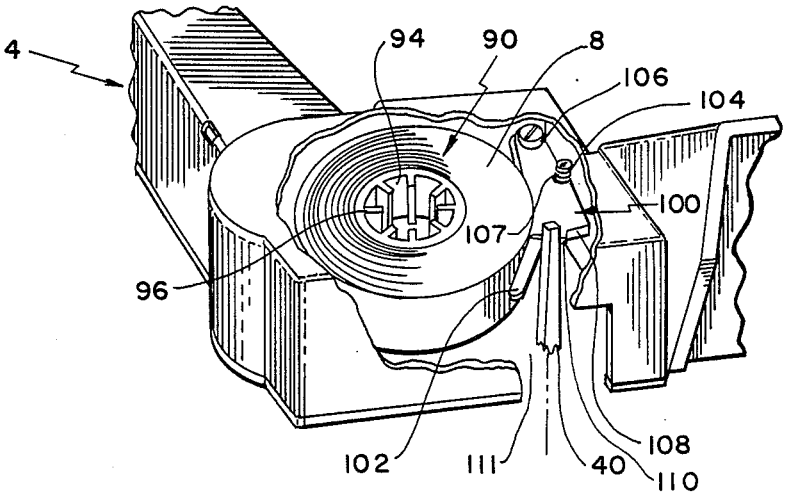
FIG. 5 is view similar to FIG. 4 showing a greater amount of correction tape on the take-spool.
Figure 6:
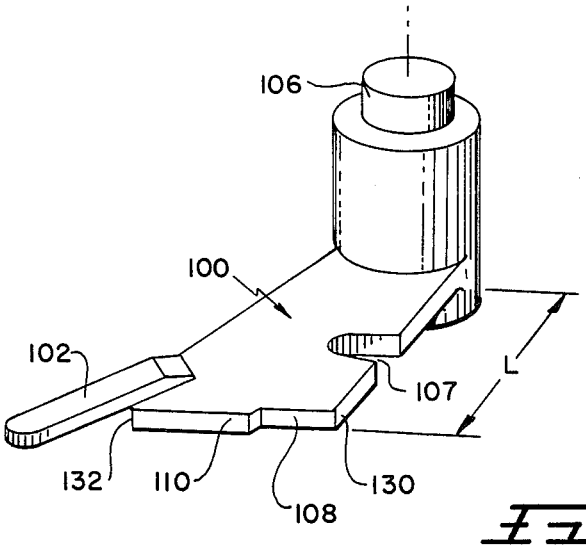
FIG. 6 is a top perspective view of the cassette sensing arm which may be used with a first type of correction tape (e.g. a lift-off correction tape)

As the take-up spool 90 rotates clockwise, it pulls the correction tape 8 from the supply spool 88 in a known manner. FIG. 4 illustrates the condition of the take-up spool 90 when a fresh correction tape 8 is present in the typewriter 13 and the amount of correction tape 8 on the take-up spool 90 is minimum. FIG. 5 illustrates the condition of the take-up spool 90 when a substantial amount of correction tape 8 has been pulled from the supply spool 88.

The correction tape cassette 4 includes a sensing arm 100 having a finger 102 biased by a spring 104 against the circumference of the correction tape 8. The spring 104 is seated at one end in a closely confining cylindrical well 105 formed in the tape cassette 4 and is seated in a notch 107 in the sensing arm 100. The sensing arm 100 pivots about a post 106 as the circumference of the correction tape 8 on the take-up spool 90 varies. The sensing arm 100 includes a first and second axial edge surface, 108, 110, of varying lengths from the post 106.

An opening 111 in the correction tape cassette 4 permits entry of the metering post 40, and engagement of the metering post 40 with either a shorter first axial surface 108 or a longer second axial surface 110. If there is a small amount of correction tape 8 on the take-up spool 90 for example, as shown in FIG. 4, then the shorter axial surface 108 of the sensing arm 100 will be engaged by the metering post 40 and the length of travel of the metering post 40 will be greater than if the larger second axial surface 110 was in the path of the metering post 40. Likewise, if there is a large amount of correction tape 8 on the take-up spool 90, for example, as shown in FIG. 5, then the longer axial surface 110 of the sensing arm 100 will be engaged by the metering post 40 and the length of travel of the metering post 40 will be lesser than if the small first axial surface 108 was in the path of the metering post 40. In this manner, it is seen that the length of travel of the metering post 40 is a function of the amount of correction tape 8 on the tape-up spool 90. Thus, the metering post 40, or at least the length of travel of the metering post 40, senses the amount of correction tape 8 present on the take-up spool 90.

As noted above, when the cassette rocker 2 is pivoted clockwise to present the correction tape 8 to the print point P, the spring 38 rotates the tape feed actuator 34 counterclockwise as shown by arrow B. In that manner, the metering post 40 is moved generally rearwardly in the direction of arrow B through the opening 111 in the correction tape cassette 4 until it engages either the shorter first axial surface 108 of the sensing arm 100 or the longer second axial surface 110 of the sensing arm 100. Thus, the amount the metering post 40 travels, and therefore the extent of counterclockwise rotation of the tape feed actuator 34, is dependent on the amount of the correction tape 8 present on the take-up spool 90. More specifically, the tape feed actuator 34 is rotated a greater distance when there is a smaller amount of the correction tape 8 present on the take-up spool 90, and a lesser distance when there is a greater amount of the correction tape 8 present on the take-up spool 90.

A feed pawl 112 is pivotally mounted on the tape feed actuator 34 by a post 114. The feed 112 is urged by a spring 116 to engage the teeth 32 of the correction tape feed wheel 30.

When the cassette rocker 2 is pivoted clockwise by the arm 10 to present the correction tape 8 at the typewriter print point P, the spring 38 rotates the tape feed actuator 34 counterclockwise until the metering post 40 engages the sensing arm 100. Further clockwise movement of the cassette rocker 2 will not cause further counterclockwise rotation of the tape feed actuator 34. During the counterclockwise rotation of the tape feed actuator 34, the feed pawl 112 will ride over the teeth 32 due to the pawl 22 preventing counterclockwise rotation of the correction tape feed wheel 30.

After presenting the correction tape 8 at the typewriter print point P and the correction step occurs, the spring 52 pivots the cassette rocker 2 counterclockwise. The lowering of the rod 46 by the cassette rocker 2 relative to the cam portion 54 causes the cam portion 54 to pivot the arm 42 clockwise. The clockwise motion of the arm 42 causes the abutment 48 to pivot the tape feed actuator 34 clockwise. The clockwise movement of the tape feed actuator 34 causes the pawl 112 to rotate the correction tape feed wheel 30 clockwise. The pawl 22 will ride over the teeth 32 during the clockwise motion of the correction tape feed wheel 30. The clockwise movement of the correction tape feed wheel 30 will rotate the take-up spool 90 clockwise for advancing the correction tape 8 relative to the typewriter print point P.

The amount of clockwise movement of the correction tape feed wheel 30 by the pawl 112 is determined by the metering post 40 engaging either the first axial surface 108 or the second axial surface 110 of the sensing arm 100 during the counterclockwise movement of the correction tape feed wheel 30. As shown in FIG. 4, the take-up spool 90 is nearly empty and the metering post 40 engages the first axial surface 108. Under this condition, the counterclockwise movement of the tape feed actuator 34 is greater during the lifting of the cassette rocker 2. Therefore, the clockwise movement of the tape feed actuator 34 is greater during lowering of the cassette rocker 2. This clockwise movement of the tape feed actuator 34 provides the greater amount of rotation of the correction tape feed wheel 30 for feeding a predetermined amount of the correction tape 8.

As shown in FIG. 5, the take-up spool 90 is nearly full and the metering post 40 engages the second axial surface 110. Under this condition, the counterclockwise movement of the tape feed actuator 34 is smaller during the lifting of the cassette rocker 2. Therefore, the clockwise movement of the tape feed actuator 34 is smaller during lowering of the cassette rocker 2. This clockwise movement of the tape feed actuator 34 provides a smaller amount of rotation of the correction tape feed wheel 30 for feeding substantially the same predetermined amount of the correction tape 8.

As previously noted the present invention is concerned with a system for metering the proper amount of correction tape 8 that is fed to the print point P in accordance with the type of correction tape 8 utilized in the cassette 4. For example, either lift or cover-up types of correction tape 8 may be housed within the cassette 4, and cassettes having both types of correction tape 8 may be used in the same typewriter 13. In such an instance, the amount of lift-off correction tape 8 that must be fed to the print point P to effectively lift off an unwanted character is less than the amount of cover-up correction tape 8 that must be fed to the print point P to effectively cover up an unwanted character.

Figure 7:
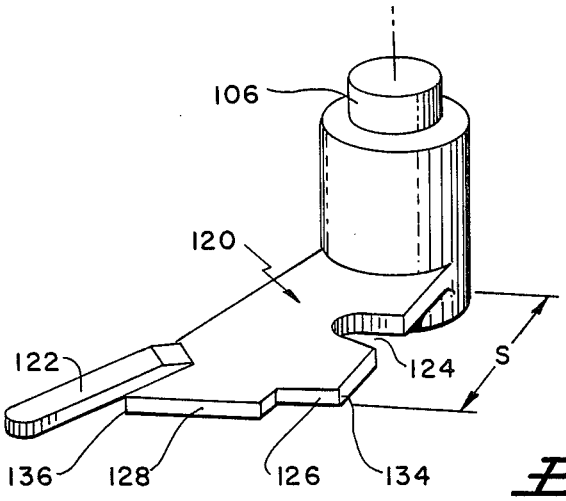
FIG. 7 is a top perspective view of the cassette sensing arm which may be used with a second type of correction tape (e.g. a cover-up correction tape)

To provide the correction tape cassette 4 with a cover-up type of correction tape 8, a different sensing arm 120 (FIG. 7) is needed. The sensing arm 120 has a finger 122 biased by the spring 104 seating in a notch 124 against the circumference of the cover-up correction tape 8. The sensing arm 120 has a first axial surface 126 located closer to the post 106, shown as measurement 5, than the first axial surface 108, shown as measurement L, of the sensing arm 100. The sensing arm 120 has a second axial surface 128 located closer to the post 106 than the second axial surface 110 of the sensing arm 100.

With the sensing arm 120 in the correction tape cassette 4, the metering post 40 travels further before engaging the first axial surface 126, when the take-up spool 90 is nearly empty, compared to engaging the first axial surface 108 of sensing arm 100. Therefore, the clockwise movement of the tape feed actuator 34 is greater and a greater amount of rotation of the correction tape feed wheel 30 for feeding the cover-up correction tape 8 a greater amount compared to the lift-off correction tape 8. Likewise, the metering post 40 travels further before engaging the second axial surface 128, when the take-up spool 90 is nearly full, compared to engaging the second axial surface 110 of the sensing arm 100. Therefore, the clockwise movement of the tape feed actuator 34 is greater and a greater amount of rotation of the correction tape feed wheel 30 will feed a greater amount of the cover-up correction tape 8 compared to the lift-off correction tape 8.

The first axial surface 126 and the second axial surface 128 on the sensing arm 120 are engaged by the metering post 40 to vary the amount of rotation of the correction tape feed wheel 30 for feeding the cover-up correction tape 8 at substantially equal increments as the amount of cover-up correction tape 8 increases on the take-up spool 90.

The first axial surface 108 and the second axial surface 110 of the sensing arm 100 are angled relative to the post 106 to continually increase the length of the measurement L between a corner 130 and a corner 132. Therefore, as the metering post 40 continually engages the first axial surface 108 and the second axial surface 110 between the corner 130 and the corner 132, the amount of clockwise rotation of the correction tape feed wheel 30 continually decreases for continually feeding substantially the same predetermined amount of the lift-off correction tape 8 as the amount of the lift-off correction tape 8 increases on the take-up spool 90.

In a same manner, the first axial surface 126 and the second axial surface 128 of the sensing arm 120 continually increase the length of the measurement S between a corner 134 and a corner 136. Therefore, as the metering post 40 continually engages the first axial surface 126 and the second axial surface 128 between the corner 134 and the corner 136, the amount of clockwise rotation of the correction tape feed wheel 30 continually decreases for continually feeding substantially equal amounts of cover-up correction tape 8 as the amount of the cover-up correction tape 8 increases on the take-up spool 90.

What is claimed is:

1. A tape cassette for removable mounting in a typewriter, the typewriter having a tape feed mechanism including a movable metering post, the tape cassette having a supply spool carrying a supply of tape and having a take-up spool for receiving tape from the supply spool, the tape cassette comprising a sensing member corresponding to a particular type of correction tape mounted therein for sensing the amount of tape on said take-up spool and being engaged by the movable metering post for determining the amount of the particular type of correction tape to be fed by the tape feed mechanism.

2. The tape cassette as defined in claim 1 wherein said sensing member is an arm mounted for pivotal movement in response to the amount of tape on the take-up spool.

3. The tape cassette as defined in claim 2 further comprising a spring mounted therein for biasing said arm against said take-up spool.

4. The tape cassette as defined in claim 2 wherein said arm has an angled edge surface engaged by the metering post at varying locations on said surface in response to the pivotal movement of said arm for varying the amount of rotation of said take-up spool by said tape feed mechanism for feeding substantially equal amounts of tape.

5. The tape cassette as defined in claim 4 wherein said surface of said arm includes a first surface portion to be engaged by the metering post for determining the amount of rotation of said take-up spool by said tape feed mechanism and a second surface portion to be engaged by the metering post for determining a lesser amount of rotation of said take-up spool for feeding substantially equal amounts of tape.

6. The tape cassette as defined in claim 2 wherein a surface on said arm is angled for engagement by the metering post of varying locations to decrease the amount of rotation of said take-up spool by the tape feed mechanism as the amount of tape increases on said take-up spool for feeding substantially equal amounts of tape, regardless of the amount of tape on the take-up spool.

7. The tape cassette as defined in claim 6 wherein said angled surface is provided with a first axial surface portion and a second axial surface portion.

8. A tape cassette for removable mounting in a typewriter, the typewriter having a tape feed mechanism including a movable metering post, the tape cassette comprising:

a housing having a opening;

a supply spool located in said housing and carrying a supply of tape;

a take-up spool for receiving the tape from the supply spool;

a sensing arm mounted in said housing for biased pivotal movement against the tape disposed upon said take-up spool, and having an angled edge surface, said opening of said cassette housing located to provide access of said metering post to said edge surface, said angled edge of said arm being configured to continually decrease the amount of rotation of said take-up spool by the decrease in movement of the tape feed mechanism as the amount of tape increases on said take-up spool for feeding substantially equal amounts of tape regardless of the amount of tape on said take-up spool.

9. The cassette as defined in claim 8 wherein said angled edge surface includes a first axial surface portion and a second axial surface portion.

10. The cassette as defined in claim 8 wherein said sensing arm is provided with a length corresponding to the type of correction tape disposed on said supply spool.

11. The cassette as defined in claim 10 wherein said length of said sensing arm provides for relatively less movement of said metering post, and correspondingly less movement of the tape feed mechanism, when lift-off correction tape is disposed on supply spool than when cover-up correction tape is disposed thereon.

12. A combination typewriter and correction tape cassette comprising:

a typewriter having a correction tape feed metering assembly including a metering post connected to a tape feed actuator for reciprocating movement;

a correction tape cassette including a housing, a tape supply spool disposed within said housing and carrying a supply of correction tape, a tape take-up spool disposed within said housing for receiving tape from said supply spool, said housing having an opening closely adjacent said take-up spool;

said cassette further including a sensing member corresponding to a particular type of correction tape mounted therein for sensing the amount of tape on said take-up spool, said member being biased against said take-up spool, said sensing member being engaged by said metering post through said opening for regulating said tape feed metering assembly.

13. The combination as defined in claim 12 wherein said sensing member is an arm having an edge surface engaged by said metering post.

14. The combination as defined in claim 13 wherein said edge surface is angled for engagement by said metering post at varying locations on said surface in response to the pivotal movement of said arm for varying the amount of rotation of the take-up spool by said tape feed metering assembly for feeding substantially equal amounts of tape regardless of the amount of tape on the take-up spool.

15. The combination as defined in claim 14 wherein said arm has a length which corresponds to a particular type of correction tape.

* * * * *